United States Patent [19]

Verhagen et al.

[11] Patent Number: 4,832,645

[45] Date of Patent: May 23, 1989

[54] METHOD OF MANUFACTURING A CATHODE RAY TUBE

[75] Inventors: Johannes W. H. Verhagen; Piet C. J. van Rens; Rienk Weening, all of Eindhoven, Netherlands

[73] Assignee: U.S. Philips Corporation, New York, N.Y.

[21] Appl. No.: 70,285

[22] Filed: Jul. 6, 1987

[30] Foreign Application Priority Data

Jul. 4, 1986 [NL] Netherlands ..... 8601738

[51] Int. Cl.[4] ..... H01J 9/34; H01J 9/42

[52] U.S. Cl. ..... 445/3; 445/34; 445/45

[58] Field of Search ..... 445/3, 4, 34, 45, 67

[56] References Cited

U.S. PATENT DOCUMENTS

| | | | |
|---|---|---|---|
| 2,459,532 | 1/1949 | Ickis | 445/4 |
| 4,055,877 | 11/1977 | Hermans | 445/34 |
| 4,189,814 | 2/1980 | Ottos | 445/34 X |

FOREIGN PATENT DOCUMENTS

| | | | |
|---|---|---|---|
| 56-333 | 4/1980 | Japan | 445/34 |

*Primary Examiner*—Kenneth J. Ramsey
*Attorney, Agent, or Firm*—John C. Fox

[57] ABSTRACT

A method of manufacturing a cathode ray tube, in which the positions of the tube envelope and the gun assembly are adjusted so their respectively longitudinal axes coincide, and then fixed against non-axial movement prior to insertion and sealing of the gun assembly into the neck of the envelope, wherein the gun assembly position is fixed by clamping at least three of its connector pins.

4 Claims, 6 Drawing Sheets

METHOD OF MANUFACTURING A CATHODE RAY TUBE

BACKGROUND OF THE INVENTION

The invention relates to a method of manufacturing a cathode ray tube, which tube comprises an envelope having a longitudinal axis and a gun assembly having a longitudinal axis and assembled on a mount in which:

a. the envelope is fixed in an assembly device in a given position;

b. the place and/or angle orientations of the gun assembly are adjusted;

c. the gun assembly is fixed in the adjusted orientation against non-axial movement;

d. the gun assembly is inserted into the neck of the envelope so that the said axes substantially coincide; and e. the mount is sealed to the neck of the envelope.

A cathode ray tube may be, for example, a television camera tube or a display tube. Display tubes have a wide field of application. They may be used, for example, as a color or projection television tube, an oscilloscope tube, a color display tube and a DGD (data graphic display) tube. All these types of tubes comprise a gun assembly to generate at least one electron beam. Said electron beam must arrive in the deflection fields in a very particular manner and land in the tube in a very particular place on a target, for example, a display screen. Therefore, a very accurate placement of the gun assembly in the envelope during the manufacture of the tube is necessary.

A method as described hereinbefore is known from DE-A 2706420. The adjusted place and/or angle orientations of the gun assembly are fixed in said method by clamping an exhaust tubulation extending from the gun mount. When the gun assembly is inserted into the tube neck, stresses may be built up in the gun assembly. Moreover, stresses may arise in the gun assembly and glass mount during mounting, notably at the area of the connection of the gun assembly to the mount. During sealing of the mount to the neck of the envelope, the mount is softened during heating. As a result, the connection of the gun assembly to the mount becomes less stable because the said stresses can be relieved, so that variations in shape and movements of the gun assembly can occur. The adjusted orientation of the gun assembly consequently loses the desired accuracy.

It is, therefore, the object of the invention to provide a method of manufacturing a cathode ray tube in which the adjusted orientation of the gun assembly is maintained during sealing.

SUMMARY OF THE INVENTION

A method of the type mentioned in the opening paragraph is for that purpose characterized according to the invention in that the fixing (according to step c.) is done by clamping at least three connector pins of the gun assembly, by means of a clamping device. The connector pins are connected to the gun assembly in a sufficiently rigid manner so that when these connector pins are clamped, substantially no shape variations or movements of the gun assembly can occur during the sealing. Thus, the gun assembly remains oriented.

An embodiment of the method in accordance with the invention is characterized in that the adjustment of the orientation of the gun assembly is done with respect to the axis of the envelope and the fixing of the adjusted orientation of the gun assembly according to step c. is done by a clamping device which is integrated with the assembly device and which clamps at least three of the connector pins connected to the gun assembly.

The place and/or angle orientation of the gun assembly may be adjusted outside the assembly device with respect to a first holder and the gun assembly may then be fixed in said position. When the assembly is to be introduced into the neck of the envelope, the clamping device and the gun assembly must be transferred to the assembly device in which the envelope is fixed in a given position.

A second holder which is substantially identically axially positioned with respect to the first holder is then necessary to position the clamping device and the gun assembly in the fixed orientation in the assembly device, after which the gun assembly is inserted into the neck of the envelope, the axis of the gun assembly substantially coinciding with the axis of the envelope.

However, when the adjustment and fixing of the orientation of the gun assembly is done by means which is integrated with the assembly device, an extra holder is not necessary.

BRIEF DESCRIPTION OF THE DRAWINGS

A limited number of embodiments of the invention will now be described with reference to the drawing in which

FIG. 6*b* is a diagrammatic sectional view of a sealing peg taken on the line 6*b*—6*b* of FIG. 6*a.

DESCRIPTION OF THE PREFERRED EMBODIMENTS

Figure 1:
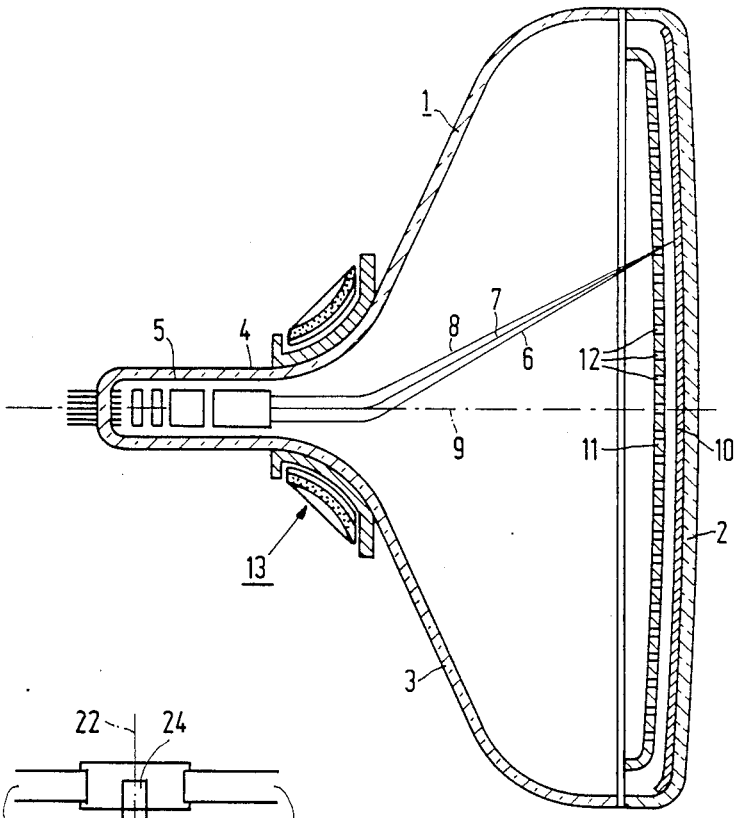
FIG. 1 is a diagrammatic longitudinal sectional view of a color cathode ray tube.

The cathode ray tube shown in FIG. 1 is a color display tube of the in-line type. An integrated electron gun system 5 is provided in the neck 4 of a glass envelope 1 which is composed of a display window 2, a cone 3 and the said neck 4. The gun 5 generates three electron beams 6, 7 and 8 which before deflection are situated with their axes in one plane. The axis of the central electron beam 7 coincides with the tube axis 9. The display window 2 comprises on its inside a large number of triplets of phosphor elements. The elements may consist of lines or dots. Each triplet comprises an element consisting of a blue-luminescing phosphor, an element consisting of a green-luminescing phosphor, and an element consisting of a red-luminescing phosphor. All triplets together consititue the display screen 10, which is substantially perpendicular to the said plane through the beam axes. In front of the display screen a shadow mask 11 is positioned in which a very large number of apertures 12 is provided through which the electron beams 6, 7 and 8 pass.

The electron beams 6, 7 and 8 are deflected in a horizontal direction (in the plane of the drawing) and in a vertical direction (perpendicular to the plane of drawing) by a system of deflection coils 13. The three electron guns are assembled so that their axes form a small angle with each other. As a result, the generated electron beams 6, 7 and 8 fall through the apertures 12 at said angle, the so-called color selection angle, and each impinge only on phosphor elements of one color. A display tube has a good static convergence when the three undeflected electron beams intersect each other substantially in the center of the display screen. However, it has been found that the static convergence, as well as the frame shape and the color purity, may be degraded as the result of an insufficiently accurate gun assembly and/or sealing of the electron guns in the tube neck.

Figure 2A:
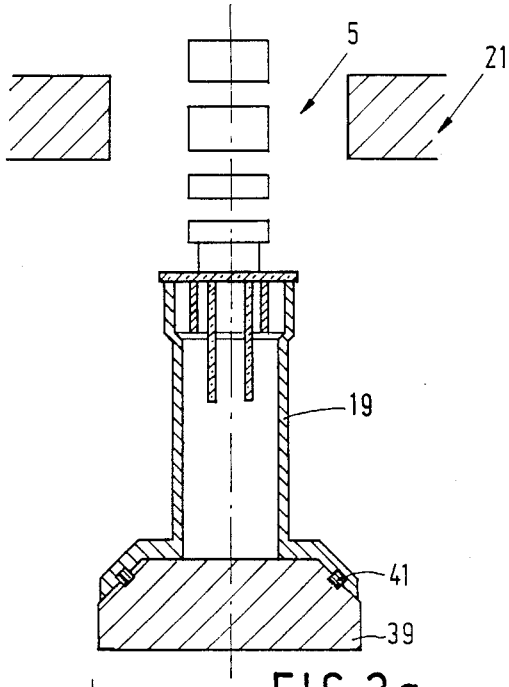
FIGS. 2*a* and 2*b* are diagrammatic longitudinal sectional views of the gun assembly and mount, and the tube envelope, respectively, in association with one embodiment of an assembly device of the invention.
Figure 2B:
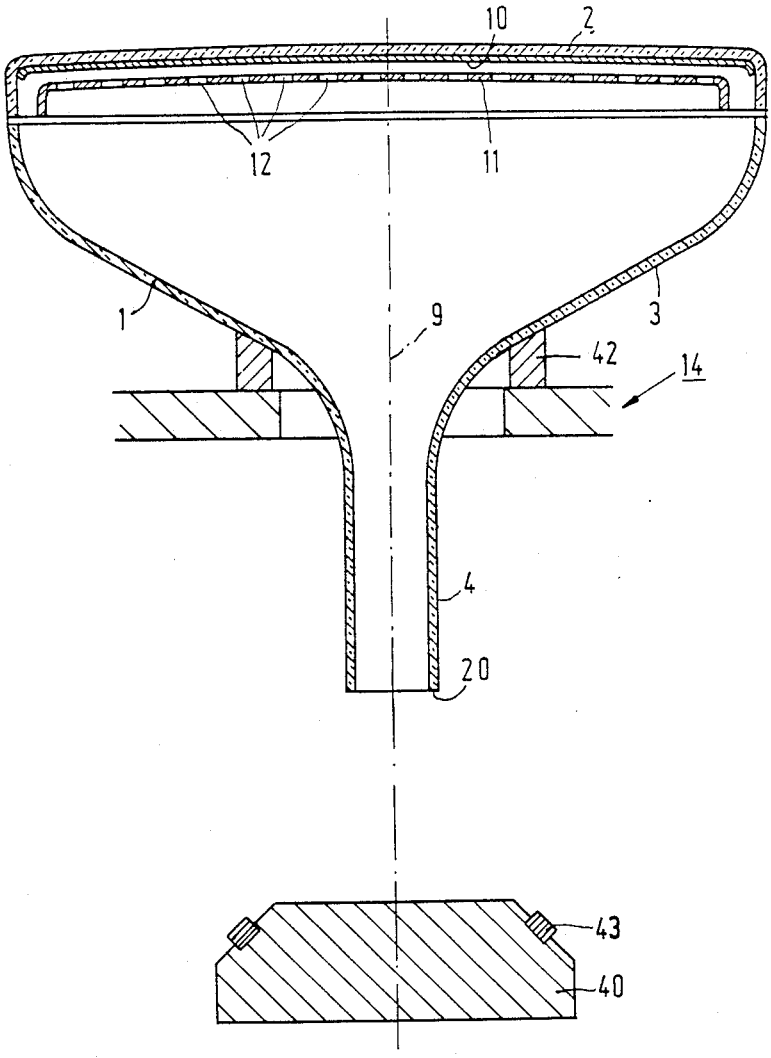

The adjustment of the orientation of the gun assembly and the fixing of the gun assembly in the adjusted orientation may be done outside the assembly device in which the envelope is fixed in a given position. After this adjustment, it is necessary to transfer the clamped gun assembly to the assembly device while maintaining axial alignment, so that the gun assembly can be inserted into the neck of the envelope, in such a way that the axes of the gun assembly and the envelope substantially coincide. For this purpose, the gun assembly 5 may be adjusted, for example, a first holder 39 outside the assembly device, as is shown diagrammatically in FIG. 2*a*. The gun assembly 5 is fixed in the adjusted orientation as will be described below with reference to FIGS. 5*a* and *b*. By transferring the gun assembly 5 and sealing peg 19 from the first holder to a holder 40 positioned in the assembly device 14, which second holder is substantially identical to the first holder 39, as is shown diagrammatically in FIG. 2*b*, the gun assembly may be inserted into the neck 4 of the envelope with the axis of the gun assembly coinciding substantially with the axis 9 of the envelope. For centering the sealing peg 19 on the holders 39 and 40, the holders 39 and 40 comprise, for example, centering rings 41 and 42.

By adjusting the place and/or angle orientation of the gun assembly with respect to the axis of the envelope part by means of a positioning device which is integrally positioned in the assembly device, and then fixing said adjusted orientation within the assembly device, additional holders need not be used.

Figure 4:
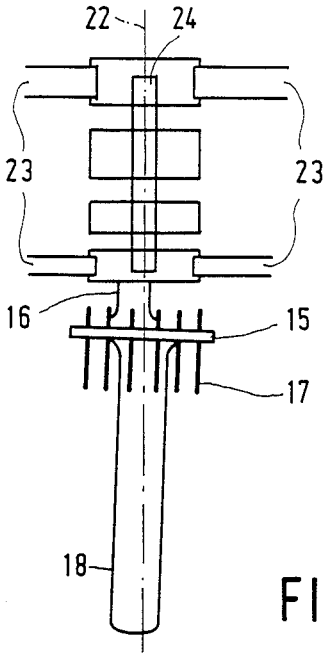
FIG. 4 is a diagrammatic elevation view of an adjustment means in engagement with the gun assembly.
Figure 3:
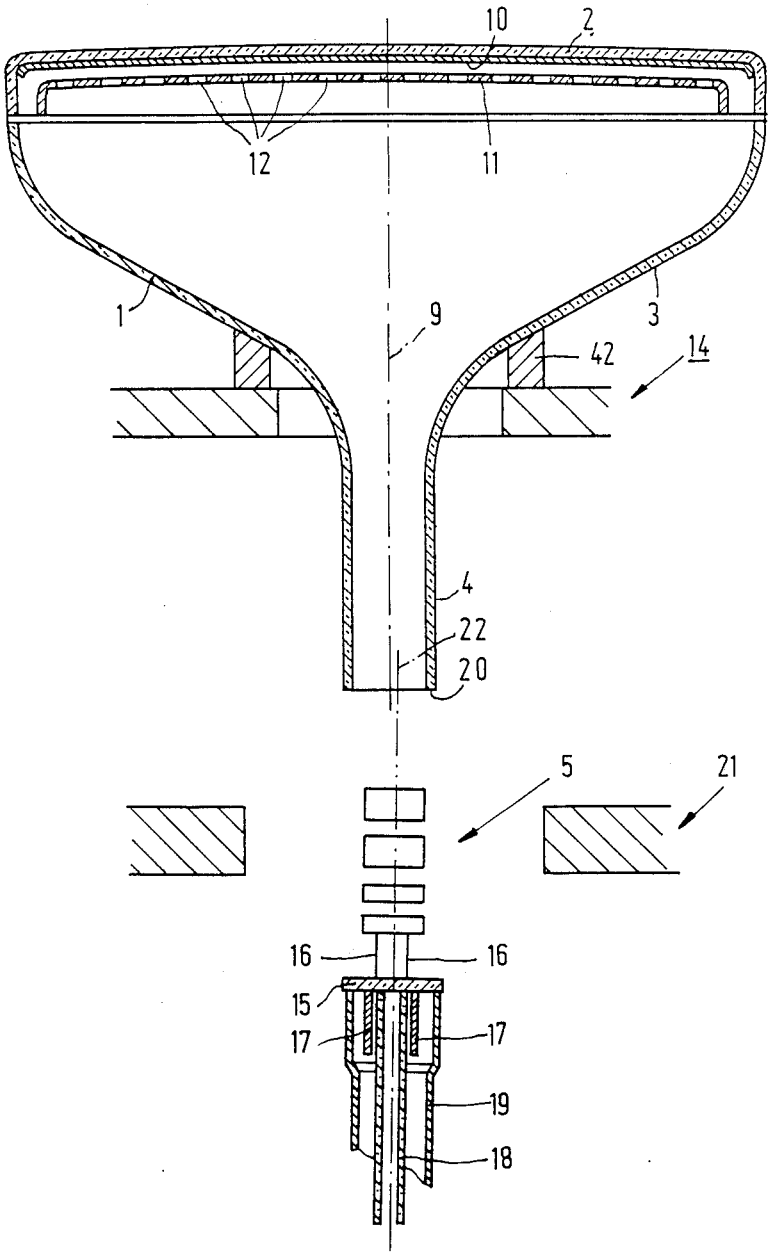
FIG. 3 is a diagrammatic longitudinal sectional view of the gun assembly and mount, and the tube envelope in association with another embodiment of an assembly device of the invention.

An embodiment of the method in accordance with the invention will now be described in greater detail with reference to FIGS. 3 and 4. The envelope 1 is fixed in an assembly device 14 in a given position. This is shown diagrammatically by means of the positioning rings 420. The gun assembly 5 comprises electrodes which are connected together by means of glass rods 24, called multiforms (FIG. 4). The gun assembly 5 is assembled on a glass plate 15, also termed the mount, by means of connector wires 16 which connect the gun electrodes to connector pins 17, which pins 17 are sealed in the mount 15. Furthermore, a glass tube 18, termed the exhaust tubulation, communicates with the interior of the envelope via an aperture in mount 15, not shown. The gun assembly 5 is placed with the pins 17 in a sealing peg 19, which sealing peg 19 forms part of the assembly device 14. The orientation of the gun assembly 5 (consisting of the electrodes and the mount 14 with the exhaust tubulation 18) is now adjusted at some distance from the neck end 20 by means of a positioning device 21 integrated with the assembly device in such a manner that the axis 22 of the gun assembly coincides substantially with the axis 9 of the envelope 1.

The adjustment of the orientation of the gun assembly 5 occurs in that the positioning device 21 directly engages electrodes of the gun assembly 5, which electrodes of the gun assembly 5 are connected together, for example, by means of multiforms 24. It has been found in practice that the adjustment of the orientation of the gun assembly 5 occurs readily when the positioning device 21 engages two electrodes of the gun assembly 5 by means of prismatic tongs 23. During the adjustment of the orientation of the gun assembly 5 the holder 39 can move freely, for example, by means of an air-cushion on which the holder 39 floats. When the orientation of the gun assembly 5 is adjusted the holder 39 is fixed in its position, for example, by means of a vacuum-chuck. By clamping three of the connection pins 17 by means of a clamping device, the adjusted orientation of the gun assembly is fixed. The positioning of the gun assembly 5, however, is not restricted to the adjustment shown in FIG. 4. It is also possible, for example, for the prismatic tongs 23 to engage two other electrodes or even one electrode.

Figure 5A:
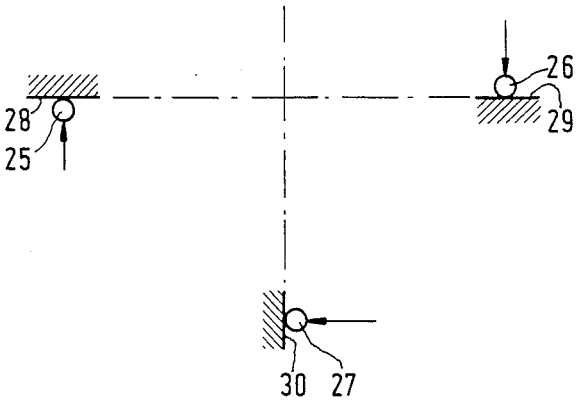
FIGS. 5*a* and 5*b* are diagrammatic sectional views of an arrangement for clamping three connector pins.
Figure 5B:
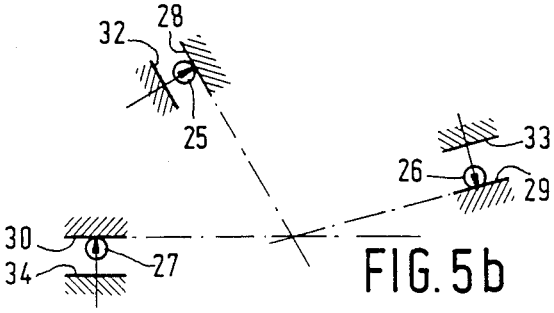

FIG. 5*a* is a diagrammatic sectional view of the principle of clamping three connection pins. The three connection pins 25, 26 and 27 are provided against three engaging surfaces 28, 29 and 30. These three engaging surfaces 28, 29 and 30 form part of a first tongs portion. Clamping the connector pins 25, 26 and 27 is done in that a second tongs portion (not shown) exerts pinching forces on the connector pins 25, 26 and 27. These pinching forces are substantially perpendicular to the engaging surfaces 28, 29 and 30 as is shown in FIG. 5*a* by arrows. The second tongs portion comprises, for example, three clamping surfaces 32, 33 and 34 as is shown diagrammatically in FIG. 5*b*. The two tongs portions together constitute the clamping device. The principle of clamping may be applied to three arbitrary connector pins. The principle of clamping can also be extended to more than three pins, although in that case an overdetermination of the position of the gun assembly is obtained.

Figure 6A:
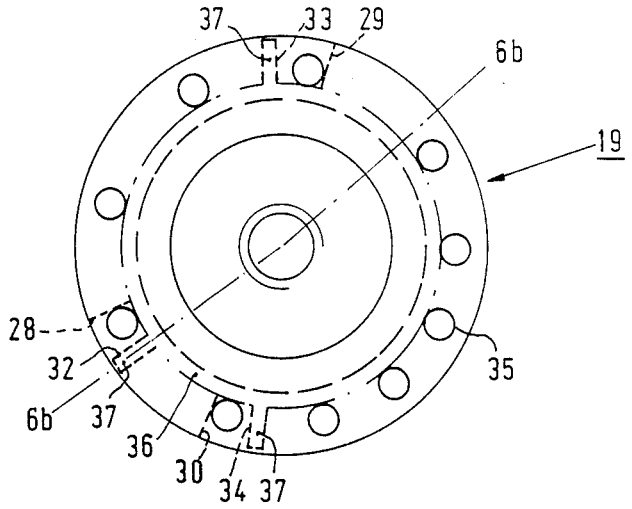
FIG. 6*a* is a diagrammatic elevation view of a sealing peg with an integrated clamping device.
Figure 6B:
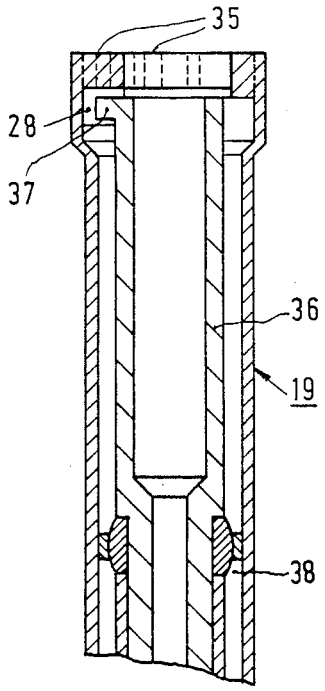

It has been found in practice that the adjusted orientation of the gun assembly can simply be fixed by integrating the clamping device with the sealing peg 19 which forms part of the assembly device. FIGS. 6*a* and 6*b* show diagrammatically an example of a sealing peg 19 with integrated clamping device. FIG. 6*a* is a plant view of the sealing peg 19 having holes 35 for receiving connector pins. The sealing peg furthermore comprises three engaging surfaces 28, 29 and 30. The sealing peg 19 comprises a clamping device consisting of a cylinder 36 present within the sealing peg 19. The cylinder 36 has projections 37 and comprises three clamping surfaces 32, 33 and 34 which correspond to the engaging surfaces 28, 29 and 30. The cylinder 36 has been mounted in the sealing peg 19 so as to be rotatable via a spherical hinge 38 (see FIG. 6*b*). When the gun assembly is placed in the sealing peg, the orientation of the gun assembly can be adjusted, by means of the positioning device, with respect to the axis of the envelope and the connector pins can be clamped between the engaging and clamping surfaces by rotating the cylinder present in the sealing peg.

Figure 7:
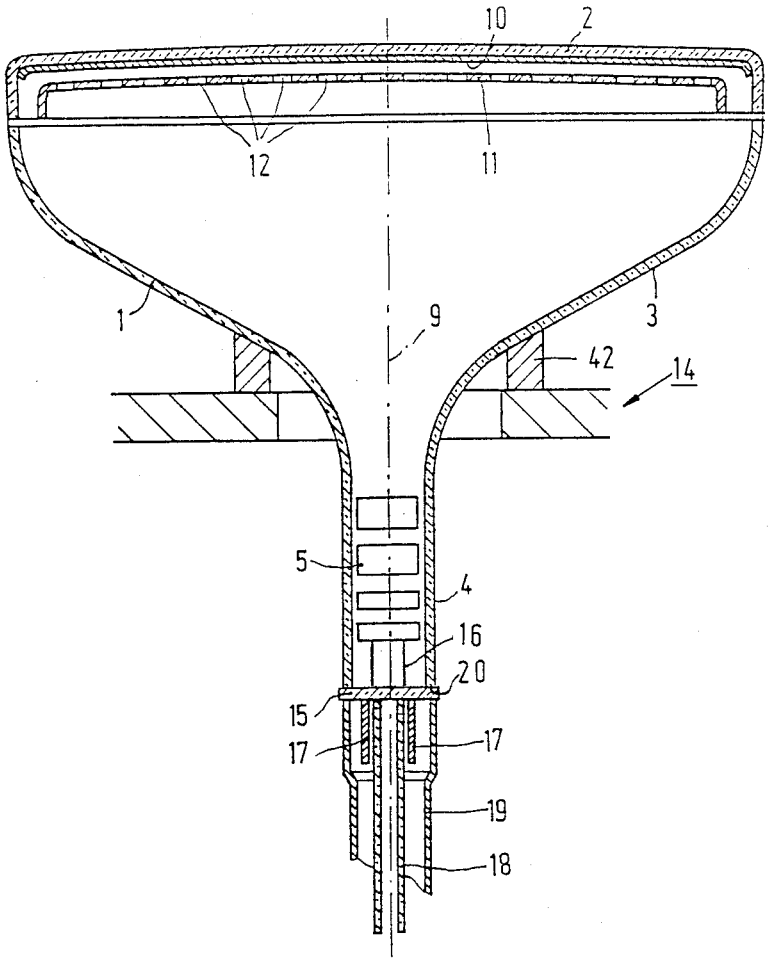
* and FIG. 7 is a diagrammatic longitudinal sectional view of a tube assembled according to the method of the invention.

Once the orientation of the gun assembly 5 has been fixed by the clamping device the gun assembly 5 is introduced into the neck of the envelope 2 in such a manner that the axis 22 of the gun assembly coincides substantially with the axis 9 of the envelope 1 as is shown diagrammatically in FIG. 7. The mount 15 is then sealed to the end 20 of the neck. Since the clamping device still clamps the connector pins 17 the softening of the mount 15 has no influence on the orientation of the gun assembly 5. When the gun assembly 5 has been sealed into the neck 4, the clamping device is removed. After further treatment, if any, the assembled tube is evacuated via the exhaust tubulation 18, after which this tubulation is sealed and removed.

The method described provides a display tube in which the axis of the gun assembly coincides accurately with the axis of the envelope of the display tube. It will be obvious that the invention is not restricted to the embodiments described, but that many variations are possible to those skilled in the art without departing from the scope of this invention.

What is claimed is:

1. A method of manufacturing a cathode ray tube, which tube comprises an envelope having a display window, a cone and a neck, and having a longitudinal axis, and further comprises a gun assembly assembled on a mount and having a plurality of connecting pins extending through the mount, and having a longitudinal axis, the method comprising:

a. adjusting the relative positions of the gun assembly and the neck of the envelope so that upon insertion of the gun assembly in the neck, the said axes substantially coincide;

b. fixing the gun assembly and neck in the adjusted positions against non-axial movement;

c. causing relative axial movement between the gun assembly and the neck to insert the gun assembly into the neck; and d. sealing the mount to the neck, characterized in that the fixing of the gun assembly is done by clamping at least three connector pins of the gun assembly.

2. A method as claimed in claim 1, characterized in that a. the envelope is fixed in an assembly device in a given position;

b. the place and/or angle orientation of the gun assembly are adjusted;

c. the gun assembly is fixed in the adjusted orientation against non-axial movement;

d. the gun assembly is moved to achieve insertion of the gun assembly into the neck so that the said axes substantially coincide; and e. the mount is sealed to the neck.

3. A method as claimed in claim 2, characterized in that clamping is carried out with respect to a first holder, and after clamping and prior to inserting the assembly into the envelope, the clamped gun assembly is transferred to a second holder which is positioned in the assembly device, and which is substantially identical to the first holder.

4. A method as claimed in claim 2, characterized in that the adjusting and clamping of the gun assembly are carried out with respect to a holder which is integrally positioned within the assembly device.

* * * * *